US009693398B2

(12) United States Patent
Kamaunu

(10) Patent No.: US 9,693,398 B2
(45) Date of Patent: Jun. 27, 2017

(54) COOKING SYSTEM

(71) Applicant: Roberta J. Kamaunu, Prescott, AZ (US)

(72) Inventor: Roberta J. Kamaunu, Prescott, AZ (US)

( * ) Notice: Subject to any disclaimer, the term of this patent is extended or adjusted under 35 U.S.C. 154(b) by 63 days.

(21) Appl. No.: 14/706,969

(22) Filed: May 8, 2015

(65) Prior Publication Data

US 2016/0330798 A1 Nov. 10, 2016

(51) Int. Cl.
*H05B 6/12* (2006.01)
*H05B 6/10* (2006.01)

(52) U.S. Cl.
CPC ..... *H05B 6/1209* (2013.01)

(58) Field of Classification Search
CPC ..... H05B 6/1254; H05B 2206/022; Y02B 40/126
USPC ..... 219/622, 620, 621, 624, 626, 627, 634, 219/660, 663, 433, 434, 440, 438; 126/215; 99/331
See application file for complete search history.

(56) References Cited

U.S. PATENT DOCUMENTS

| | | | | |
|---|---|---|---|---|
| 4,348,571 | A * | 9/1982 | Dills | H05B 6/1254 219/622 |
| 4,607,613 | A | 8/1986 | Toldi | |
| 4,927,997 | A | 5/1990 | Bailey | |
| 5,041,720 | A | 8/1991 | Esposito | |
| 7,446,287 | B2 | 11/2008 | Tominaga et al. | |
| 7,906,748 | B2 | 3/2011 | Imura | |
| 8,766,147 | B2 | 7/2014 | Reischmann et al. | |
| 2010/0000980 | A1* | 1/2010 | Popescu | A47J 36/20 219/201 |
| 2013/0139704 | A1 | 6/2013 | Schilling et al. | |
| 2013/0334207 | A1 | 12/2013 | Park | |
| 2014/0124501 | A1* | 5/2014 | Shaffer | H05B 6/1254 219/621 |

* cited by examiner

*Primary Examiner* — Quang Van

(57) ABSTRACT

A cooking system for using a non-ferromagnetic pot to cook on an induction cooker includes an induction cooker that has a heating surface. A panel is positioned to abut the heating surface. The panel is constructed of a ferromagnetic material wherein the panel is placed in thermal communication with the induction cooker when the panel is positioned on the heating surface. Thus, the induction cooker heats the panel.

4 Claims, 3 Drawing Sheets

COOKING SYSTEM

BACKGROUND OF THE DISCLOSURE

Field of the Disclosure

The disclosure relates to cooking devices and more particularly pertains to a new cooking device for using a non-ferromagnetic pot to cook on an induction cooker.

SUMMARY OF THE DISCLOSURE

An embodiment of the disclosure meets the needs presented above by generally comprising an induction cooker that has a heating surface. A panel is positioned to abut the heating surface. The panel is comprised of a ferromagnetic material wherein the panel is placed in thermal communication with the induction cooker when the panel is positioned on the heating surface. Thus, the induction cooker heats the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
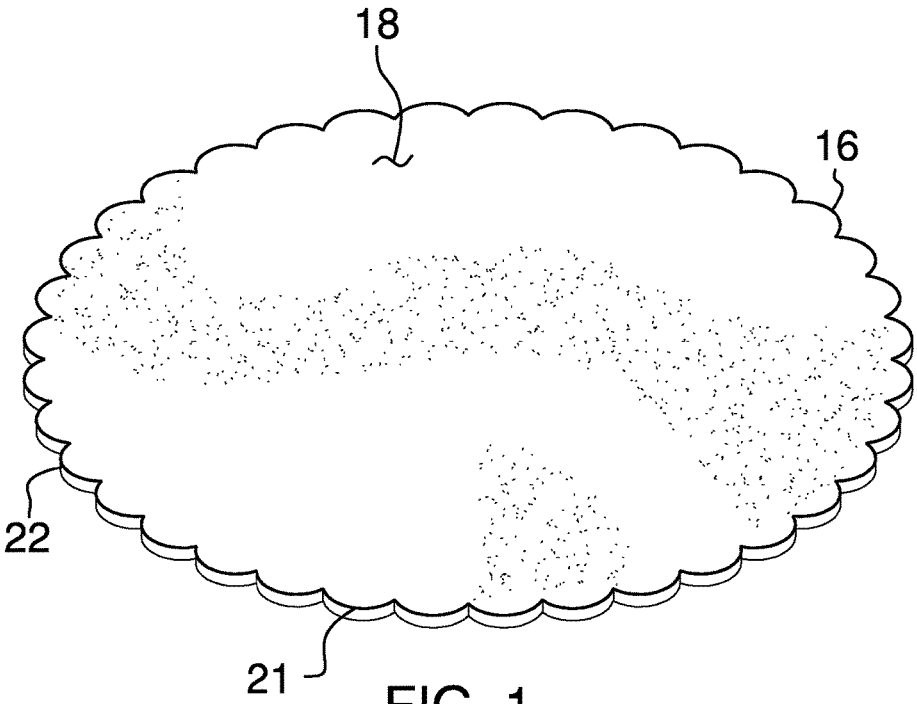
FIG. 1 is a perspective view of a cooking system according to an embodiment of the disclosure.
Figure 2:
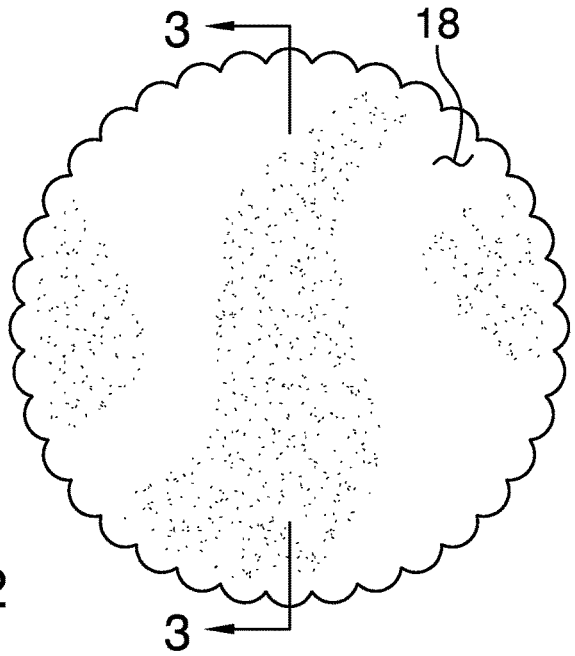
FIG. 2 is a top view of an embodiment of the disclosure.
Figure 3:
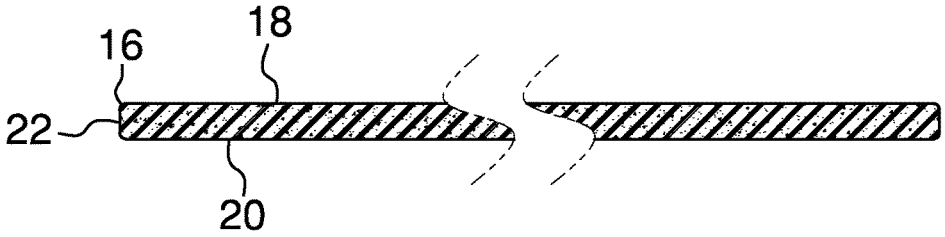
FIG. 3 is a cross sectional view taken along line 3-3 of FIG. 2 of an embodiment of the disclosure.
Figure 4:
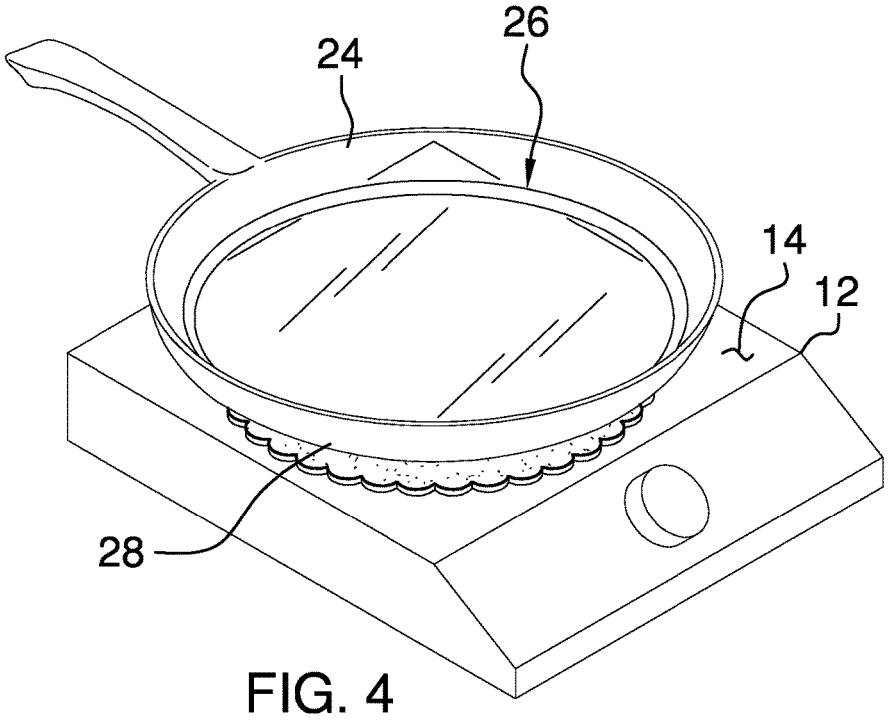
FIG. 4 is a perspective in-use view of an embodiment of the disclosure.
Figure 5:
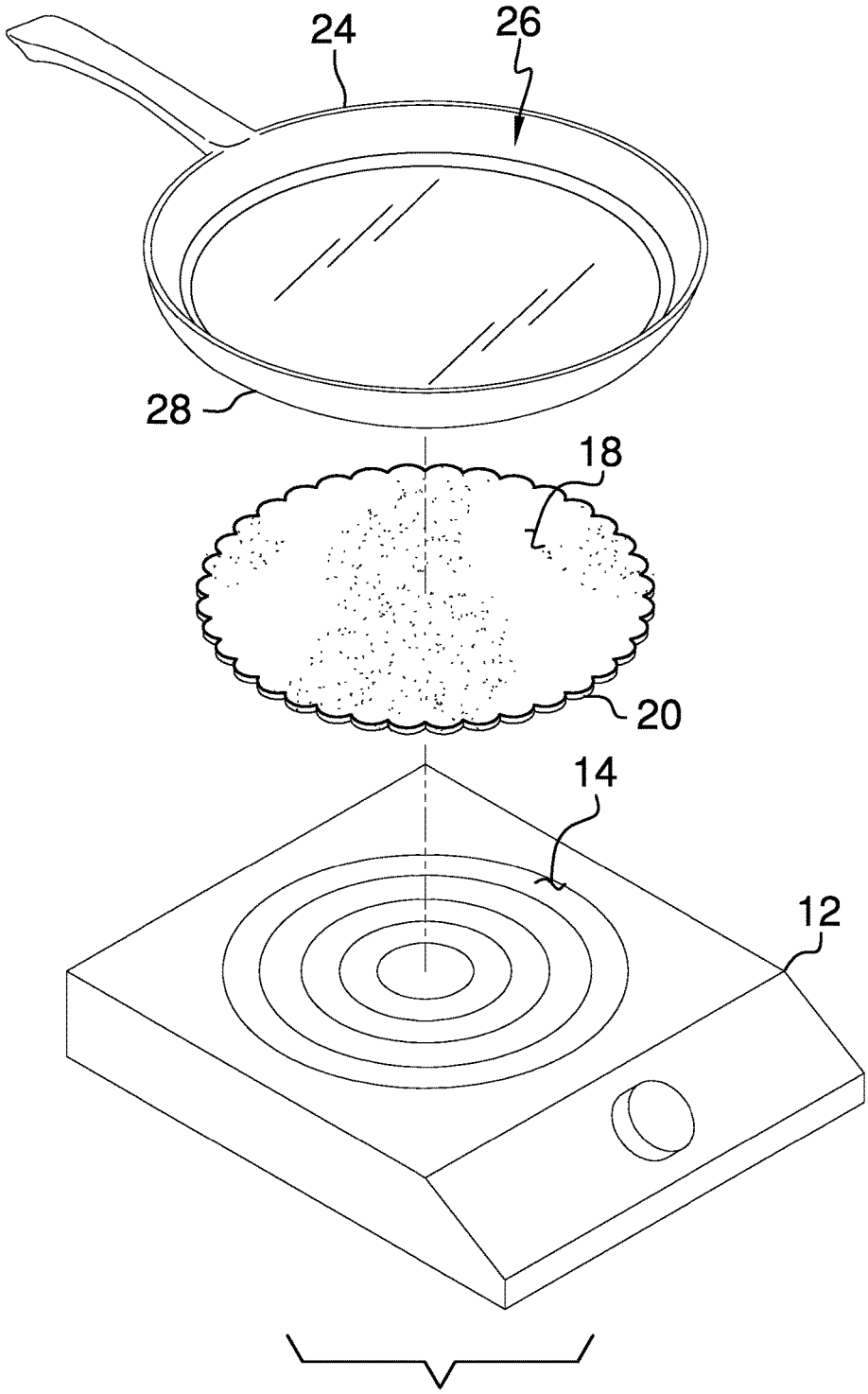
FIG. 5 is an exploded in-use view of an embodiment of the disclosure.

With reference now to the drawings, and in particular to FIGS. 1 through 5 thereof, a new cooking device embodying the principles and concepts of an embodiment of the disclosure and generally designated by the reference numeral 10 will be described.

As best illustrated in FIGS. 1 through 5, the cooking system 10 generally comprises an induction cooker 12 that has a heating surface 14. The induction cooker 12 may be an electrical induction cooker of any conventional design. A panel 16 is provided that has a top surface 18, a bottom surface 20 and a peripheral edge 22 extending between the top surface 18 and the bottom surface 20. The peripheral edge 22 is continuous such that the panel 16 has a circular cross section taken perpendicular to an axis extending through the top surface 18 and the bottom surface 20.

The peripheral edge 22 is scalloped around an entire circumference of the peripheral edge 22 and the bottom surface 20 may be positioned to abut the heating surface 14. The peripheral edge 22 is scalloped to prevent the panel 16 from having a sharp edge. The panel 16 is comprised of a ferromagnetic material wherein the panel 16 is placed in thermal communication with the induction cooker 12 when the bottom surface 20 is positioned on the heating surface 14. Thus, the induction cooker 12 may heat the panel 16.

A pot 24 is provided that has a cooking portion 26 and the cooking portion 26 has a lower surface 28. The pot 24 is positioned on the panel 16 having the lower surface 28 abutting the top surface 18 and the pot 24 is comprised of a non-ferromagnetic material. The non-ferromagnetic material may comprise glass, copper, aluminum or other rigid, non-ferromagnetic material. The pot 24 is placed in thermal communication with the panel 16 when the lower surface 28 is positioned on the top surface 18. Thus, the panel 16 heats the pot 24 thereby facilitating the pot 24 to be used to cook on the induction cooker 12.

In use, the bottom surface 20 of the panel 16 is placed on the cooking surface 14 of the induction cooker 12. The pot 24 is placed on the top surface 20 of the panel 16 such that lower surface 28 of the pot 24 abuts the top surface 20. The induction cooker 12 is turned on and the induction cooker 12 heats the panel 16. The panel 16 transfers the heat into the pot 24 thereby facilitating the pot 24 to be utilized for cooking on the induction cooker 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cooking system comprising:

an induction cooker having a heating surface;

a panel being positioned to abut said heating surface, said panel being comprised of a ferromagnetic material wherein said panel is placed in thermal communication with said induction cooker when said panel is positioned on said heating surface thereby facilitating said induction cooker to heat said panel; and wherein said panel has a top surface, a bottom surface and a peripheral edge extending between said top surface and said bottom surface, said peripheral edge being continuous such that said panel has a circular cross section taken perpendicular to an axis extending through said top surface and said bottom surface, said peripheral edge being scalloped around an entire circumference of said peripheral edge.

2. The assembly according to claim 1, further comprising a pot having a cooking portion, said cooking portion having a lower surface, said pot being positioned on said panel having said lower surface abutting said top surface.

3. The assembly according to claim 2, wherein said pot is comprised of a non-ferromagnetic material, said pot being placed in thermal communication with said panel when said lower surface is positioned on said top surface wherein said panel heats said pot thereby facilitating said pot to be used to cook on said induction cooker.

4. A cooking system comprising:

an induction cooker having a heating surface;

a panel having a top surface, a bottom surface and a peripheral edge extending between said top surface and said bottom surface, said peripheral edge being continuous such that said panel has a circular cross section taken perpendicular to an axis extending through said top surface and said bottom surface, said peripheral edge being scalloped around an entire circumference of said peripheral edge, said bottom surface being positioned to abut said heating surface, said panel being comprised of a ferromagnetic material wherein said panel is placed in thermal communication with said induction cooker when said bottom surface is positioned on said heating surface thereby facilitating said induction cooker to heat said panel; and a pot having a cooking portion, said cooking portion having a lower surface, said pot being positioned on said panel having said lower surface abutting said top surface, said pot being comprised of a non-ferromagnetic material, said pot being placed in thermal communication with said panel when said lower surface is positioned on said top surface wherein said panel heats said pot thereby facilitating said pot to be used to cook on said induction cooker.

* * * * *